US011699410B2

(12) United States Patent
Liu

(10) Patent No.: US 11,699,410 B2
(45) Date of Patent: Jul. 11, 2023

(54) DRIVING CIRCUIT OF DISPLAY PANEL AND DISPLAY DEVICE

(71) Applicant: TCL China Star Optoelectronics Technology Co., Ltd., Guangdong (CN)

(72) Inventor: Yi Liu, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 259 days.

(21) Appl. No.: 17/263,963

(22) PCT Filed: Dec. 30, 2020

(86) PCT No.: PCT/CN2020/141356

§ 371 (c)(1),
(2) Date: Jan. 28, 2021

(87) PCT Pub. No.: WO2022/141183

PCT Pub. Date: Jul. 7, 2022

(65) Prior Publication Data

US 2022/0398991 A1 Dec. 15, 2022

(30) Foreign Application Priority Data

Dec. 28, 2020 (CN) ..... 202011575236.X

(51) Int. Cl.
*G09G 3/36* (2006.01)
*G09G 3/20* (2006.01)

(52) U.S. Cl.
CPC ..... *G09G 3/3677* (2013.01); *G09G 3/2096* (2013.01); *G09G 2300/043* (2013.01); *G09G 2300/0408* (2013.01); *G09G 2310/08* (2013.01); *G09G 2330/021* (2013.01); *G09G 2370/00* (2013.01)

(58) Field of Classification Search
None
See application file for complete search history.

(56) References Cited

FOREIGN PATENT DOCUMENTS

| | | | |
|---|---|---|---|
| CN | 103412427 | 11/2013 | |
| CN | 104537978 | 4/2015 | |
| CN | 107481657 | 12/2017 | |
| CN | 108831400 | 11/2018 | |
| CN | 107481657 | * 2/2020 | ..... G09G 3/20 |
| JP | 2005-321510 | 11/2005 | |

* cited by examiner

*Primary Examiner* — Ifedayo B Iluyomade

(57) ABSTRACT

The present disclosure provides a driving circuit of a display panel and a display device. The driving circuit includes a gate-on-array (GOA) circuit transmitting a scan driving signal to the display panel through a corresponding gate signal line, and further includes a pull-down module and a control bus. The pull-down module is activated at a falling edge of a gate driving signal to accelerate a potential descent speed of the pull-down module, thereby increasing a charging time of a thin film transistor and realizing a narrow-frame display panel.

18 Claims, 3 Drawing Sheets

DRIVING CIRCUIT OF DISPLAY PANEL AND DISPLAY DEVICE

RELATED APPLICATIONS

This application is a National Phase of PCT Patent Application No. PCT/CN2020/141356 having International filing date of Dec. 30, 2020, which claims the benefit of priority of Chinese Patent Application No. 202011575236.X filed on Dec. 28, 2020. The contents of the above applications are all incorporated by reference as if fully set forth herein in their entirety.

FIELD AND BACKGROUND OF THE INVENTION

The present disclosure relates to the field of display panel technology, and more particularly, to a driving circuit of a display panel and a display device.

In recent years, with development in display technology, people have higher demands on types, uses, and functions of display panels.

Among them, narrow-frame display panels, which have narrow frames, high screen ratio, and large display areas, are gradually becoming a focus in the market. For example, a thin film transistor (TFT) liquid crystal display device comprises a liquid crystal display panel, a gate driving circuit, and a source driving circuit. In the prior art, in order to realize narrow frame, a driving circuit (gate on array, GOA) outside a display area of the display panel and located on both sides of the frame is often transferred to a position on one side of the source driving circuit and is directly connected to inside of the panel through a gate signal line. However, in the two above-mentioned narrow-frame driving schemes, when the gate signal line transmits a driving signal to a liquid crystal pixel at a distal end, a pixel cell at the distal end is far away from a start end where the signal is outputted. Therefore, the signal line at the distal end is connected in series with loads such as capacitance and resistance, etc. during transmission, so that waveforms at the distal end are changed, thereby causing the pixel to be undercharged, causing serious distortion of display images, poor reliability of the panel, etc.

Therefore, there is a need for solutions to the problems in the prior art.

SUMMARY OF THE INVENTION

In view of the above, in conventional driving circuit design of the narrow-frame display panel, when signal transmission is performed, a distal end of a control signal line is connected in series with more capacitive resistance loads, so that the pixel is undercharged, display image is distorted, and reliability and display effect of the panel are poor.

An embodiment of the present disclosure provides a driving circuit of a display panel and a display device to improve a screen display effect of a narrow-frame display panel and comprehensive performance of the display panel.

To solve the above technical problems, the technical solutions provided in the embodiments of the present disclosure are as follows:

A first aspect of an embodiment of the present disclosure provides a driving circuit of a display panel, comprising:

A GOA circuit comprising a GOA unit connected to one end of a gate signal line to transmit a scan driving signal to the display panel; and A pull-down module, wherein one end of the pull-down module is connected to a control bus, the other end of the pull-down module is connected to the other end of the gate signal line, and the pull-down module is activated at a falling edge time of the scan driving signal to accelerate a potential descending speed of the scan driving signal;

The driving circuit of the display panel further comprises a timing controller, the control bus is connected to the timing controller and the pull-down module, and the control bus comprises a plurality of clock signal lines and power supply voltage signal lines, and two adjacent signal lines are arranged at equal intervals.

According to an embodiment of the present disclosure, the control bus is disposed around a non-display area of the display panel, the timing controller and the GOA circuit are disposed on one side of the display panel, and the pull-down module is disposed on the other side of the display panel.

According to an embodiment of the present disclosure, the pull-down module comprises an inverter and a pull-down control module, an input terminal of the inverter is connected to the control bus, an output terminal of the inverter is connected to one end of the pull-down control module, and the other end of the pull-down control module is correspondingly connected to the other end of the gate signal line.

According to an embodiment of the present disclosure, the inverter comprises:

A first thin film transistor, wherein a gate of the first thin film transistor is electrically connected to a first control signal line;

A second thin film transistor, wherein a gate of the second thin film transistor is electrically connected to a second control signal line, a drain is electrically connected to a source of the first thin film transistor, and a source is electrically connected to a third control signal line;

A third thin film transistor, wherein a gate of the third thin film transistor is electrically connected to the drain electrode of the second thin film transistor, and a drain is electrically connected to the first control signal line and a drain electrode of the first thin film transistor;

A fourth thin film transistor, wherein a gate of the fourth thin film transistor is electrically connected to the gate of the second thin film transistor, a drain is electrically connected to a source of the third thin film transistor, and a source is electrically connected to the third control signal line.

According to an embodiment of the present disclosure, the pull-down control module comprises a fifth thin film transistor and a first capacitance, wherein a gate of the fifth thin film transistor is electrically connected to the drain of the fourth thin film transistor and the source of the third thin film transistor, a source of the fifth thin film transistor is electrically connected to the third control signal line, and a drain of the fifth thin film transistor is connected to the other end of the gate signal line, wherein one end of the first capacitor is electrically connected to the drain of the fifth thin film transistor and the other end of the gate signal line, and the other end of the first capacitor is electrically connected to a fourth control signal line.

According to an embodiment of the present disclosure, the first control signal line transmits a first voltage, the first voltage is a direct current high-level voltage, and a voltage value of the first voltage is the same as a voltage value of the GOA circuit at a high potential.

According to an embodiment of the present disclosure, the third control signal line transmits a second voltage, the second voltage is a direct current low-level voltage, and a voltage value of the second voltage is the same as a voltage value of the GOA circuit at a low potential.

On the second aspect, the present disclosure provides a driving circuit of a display panel, comprising:

A GOA circuit comprising a GOA unit connected to one end of a gate signal line to transmit a scan driving signal to the display panel; and A pull-down module, wherein one end of the pull-down module is connected to a control bus, the other end of the pull-down module is connected to the other end of the gate signal line, and the pull-down module is activated at a falling edge time of the scan driving signal to accelerate a potential descending speed of the scan driving signal.

According to an embodiment of the present disclosure, the driving circuit of the display panel further comprises a timing controller, and the control bus is connected to the timing controller and the pull-down module.

According to an embodiment of the present disclosure, the control bus is disposed around a non-display area of the display panel, the timing controller and the GOA circuit are disposed on one side of the display panel, and the pull-down module is disposed on the other side of the display panel.

According to an embodiment of the present disclosure, the pull-down module comprises an inverter and a pull-down control module, an input terminal of the inverter is connected to the control bus, an output terminal of the inverter is connected to one end of the pull-down control module, and the other end of the pull-down control module is correspondingly connected to the other end of the gate signal line.

According to an embodiment of the present disclosure, the inverter comprises:

A first thin film transistor, wherein a gate of the first thin film transistor is electrically connected to a first control signal line;

A second thin film transistor, wherein a gate of the second thin film transistor is electrically connected to a second control signal line, a drain is electrically connected to a source of the first thin film transistor, and a source is electrically connected to a third control signal line;

A third thin film transistor, wherein a gate of the third thin film transistor is electrically connected to the drain electrode of the second thin film transistor, and a drain is electrically connected to the first control signal line and a drain electrode of the first thin film transistor;

A fourth thin film transistor, wherein a gate of the fourth thin film transistor is electrically connected to the gate of the second thin film transistor, a drain is electrically connected to a source of the third thin film transistor, and a source is electrically connected to the third control signal line.

According to an embodiment of the present disclosure, the pull-down control module comprises a fifth thin film transistor and a first capacitance, wherein a gate of the fifth thin film transistor is electrically connected to the drain of the fourth thin film transistor and the source of the third thin film transistor, a source of the fifth thin film transistor is electrically connected to the third control signal line, and a drain of the fifth thin film transistor is connected to the other end of the gate signal line, wherein one end of the first capacitor is electrically connected to the drain of the fifth thin film transistor and the other end of the gate signal line, and the other end of the first capacitor is electrically connected to a fourth control signal line.

According an embodiment of the present disclosure, the first control signal line transmits a first voltage, the first voltage is a direct current high-level voltage, and a voltage value of the first voltage is the same as a voltage value of the GOA circuit at a high potential.

According to an embodiment of the present disclosure, the third control signal line transmits a second voltage, the second voltage is a direct current low-level voltage, and a voltage value of the second voltage is the same as a voltage value of the GOA circuit at a low potential.

According to an embodiment of the present disclosure, the control bus comprises a plurality of clock signal lines and power supply voltage signal lines, and two adjacent signal lines are arranged at equal intervals.

On a third aspect, the present disclosure further provides a display device comprising a driving circuit of a display panel, wherein the driving circuit comprises:

A GOA circuit comprising a GOA unit connected to one end of a gate signal line to transmit a scan driving signal to the display panel; and A pull-down module, wherein one end of the pull-down module is connected to a control bus, the other end of the pull-down module is connected to the other end of the gate signal line, and the pull-down module is activated at a falling edge time of the scan driving signal to accelerate a potential descending speed of the scan driving signal.

According to an embodiment of the present disclosure, the driving circuit of the display panel further comprises a timing controller, and the control bus is connected to the timing controller and the pull-down module.

According to an embodiment of the present disclosure, the control bus is disposed around a non-display area of the display panel, the timing controller and the GOA circuit are disposed on one side of the display panel, and the pull-down module is disposed on the other side of the display panel.

According to an embodiment of the present disclosure, the pull-down module comprises an inverter and a pull-down control module, an input terminal of the inverter is connected to the control bus, an output terminal of the inverter is connected to one end of the pull-down control module, and the other end of the pull-down control module is correspondingly connected to the other end of the gate signal line.

In summary, advantageous effects of the embodiments of the present disclosure are as follows:

An embodiment of the present disclosure provides a driving circuit of a display panel and a display device. In the embodiment of the present disclosure, a pull-down module is disposed on one side of the display panel, one end of the pull-down module is connected to a control bus, and the other end of the pull-down module is connected to the other end of each of the gate signal lines, wherein the pull-down module is activated at a falling edge time of a scanning driving signal to accelerate a potential descending speed of the scanning driving signal, thereby ensuring that a falling edge of a data driving signal line reaches a threshold voltage only after the scanning driving signal line descends to a threshold voltage. Waveform distortion of the scanning driving signal at the distal end is effectively reduced, display effect of the display panel is improved, and the design of the narrow-frame display panel is realized.

DESCRIPTION OF SPECIFIC EMBODIMENTS OF THE INVENTION

The following description of the embodiments is made with reference to the accompanying drawings to illustrate specific embodiments in which the present disclosure may be practiced.

The present disclosure provides a driving circuit of a display panel and a display device. A pull-down module is provided in the display panel. The pull-down module, under action of a control bus, activates at a falling edge time of a scanning driving signal of the display panel and accelerates a descending speed of a potential of the scanning driving signal, thereby reducing a waveform distortion problem of a gate output signal at a distal end, controlling charging and discharging time of thin film transistors, improving display effect of the display panel, and realizing a narrow-frame display panel.

Figure 1:
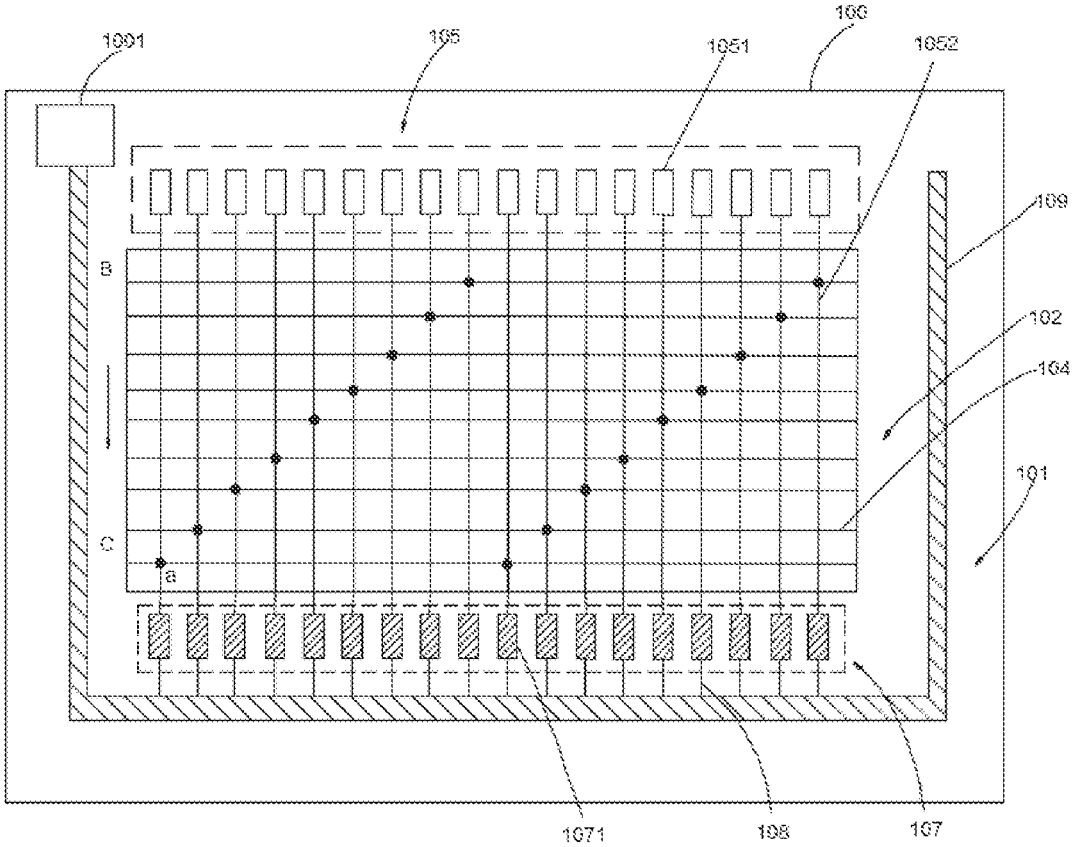
FIG. 1 is a schematic structural diagram of a display panel according to an embodiment of the present disclosure.

As shown in FIG. 1, FIG. 1 is a schematic structural diagram of a display panel according to an embodiment of the present disclosure. The display panel comprises a display area 102 and a frame area 101. The frame area 101 may be disposed around the display area 102, and in this embodiment of the present disclosure, the frame area 101 is a non-display area of the display panel.

Further, the display panel further comprises a substrate 100, and a gate-on-array (GOA) circuit 105, wherein in this embodiment of the present disclosure, the display panel is preferably a narrow-frame display panel. Therefore, when the GOA circuit 105 is provided, the GOA circuit may be disposed on one side of the display panel to achieve the purpose of the narrow-frame panel. Further, the GOA circuit 105 further comprises a plurality of GOA cells 1051, and a plurality of output signal lines are also provided in the GOA circuit 105, and the output signal lines are connected to each of the GOA cells to transmit control signals for the display panel. In this embodiment of the present disclosure, a gate signal line 1052 is used as an example for description.

In this embodiment of the present disclosure, two GOA circuits are used as examples. In order to realize a narrow-frame display panel, when the GOA circuit 105 is provided, the GOA circuit 105 is disposed in a non-display area in which the display panel is close to the frame area. Therefore, a narrow-frame display panel is realized.

In an embodiment of the present disclosure, data lines and scanning lines are further alternatingly disposed in the display area of the display panel. The data lines and the scanning lines are alternated with each other, and a plurality of pixel cells are disposed in the area where the data lines and the scanning lines intersect, and the data lines and the scanning lines provide data signals and scanning signals for thin film transistors, respectively, to realize light emission during display of the display panel. The above-mentioned arrangements are all normal configuration arrangements of the display panel and will not be described in detail here.

For the narrow-frame display panel, since the gate signal line 1052 leading from one side of the GOA circuit 105 needs to extend to the other side of the display panel, i.e., the gate signal line 1052 extends from the B terminal to the C terminal, the B terminal is relatively close to a side of GOA circuit 105, and the C terminal is relatively far from the GOA circuit side, so that the gate signal line 1052 corresponding to the C terminal is connected in series with more loads such as capacitance and resistance compared with the gate signal line 1052 at the B terminal. When the scanning signal of the gate signal line 1052 is transmitted to the C terminal, a serious signal waveform distortion problem may occur, for example, when the signal waveform is a square wave at the B terminal, and the waveform of the signal at the C terminal may become a triangular waveform, thereby affecting normal display of the display panel.

In this embodiment of the present disclosure, each gate signal line 1052 extends distally in a vertical direction and is electrically connected to a scanning line 104 through an entry point a in each line. The display panel provided in the embodiment of the present disclosure further comprises a pull-down module 107 and a control bus 109.

Specifically, the pull-down module 107 and the control bus 109 are disposed in the non-display area 101 of the display panel, preferably on an opposite side of the GOA circuit 105, to realize a narrow frame. One end of the pull-down module 107 is electrically connected to the control bus 109, and the other end of the pull-down module 107 is electrically connected to the other end of the gate signal line 1052, specifically the pull-down module 107 is electrically connected to the control bus 109 through a plurality of wires 108. The control bus 109 comprises a plurality of control signal lines.

In this embodiment of the present disclosure, the gate signal line 1052 and the pull-down module 107 cooperate with each pixel cell so that a falling edge of a data signal transmitted to the pixel cell corresponds to a falling edge of a gate signal, thereby ensuring that the thin film transistor can be normally charged and discharged, ensuring that the display panel is normally displayed, and improving the display effect of the display panel.

Specifically, the pull-down module 107 may comprise a plurality of pull-down circuit units 1071. One end of the pull-down module 107 is electrically connected to the display panel through a plurality of wires, and the other end of the pull-down module 107 is electrically connected to the control bus 109 of the display panel through the second wires 108.

The display panel further comprises a timing controller 1001, the control bus 109 is connected to the timing controller 1001 and the pull-down module 107. The timing controller 1001 and the GOA circuit 105 are disposed on a same side of the display panel, and the pull-down module 107 is disposed on another side of the display panel.

In an embodiment of the present disclosure, the pull-down module 107 may be disposed in an area between the display area 102 and the control bus 109. The control bus 109 is disposed around the frame area 101 and provides input or control signals to the pull-down module 107 via the control bus 109.

Figure 2:
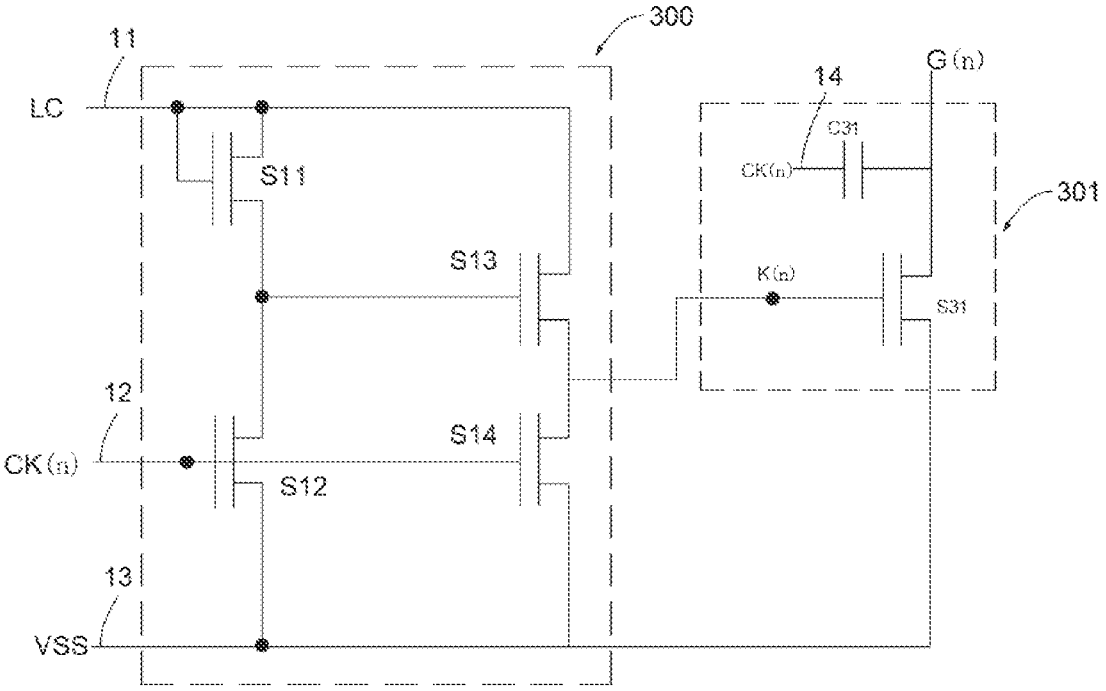
FIG. 2 is a schematic structural diagram of a circuit of a pull-down module according to an embodiment of the present disclosure.

As shown in FIG. 2, FIG. 2 is a structural schematic diagram of a circuit of the pull-down circuit unit according to this embodiment of the present disclosure. In this embodiment of the present disclosure, the pull-down module may comprise an inverter 300 and a pull-down control module 301. An input end of the inverter 300 is connected to the control bus, an output end K(n) of the inverter 300 is connected to one end of the pull-down control module 301, and the other end of the pull-down control module is correspondingly connected to the other end of each of the gate signal lines.

In this embodiment of the present disclosure, the inverter 300 comprises a first thin film transistor S11, a second thin film transistor S12, a third thin film transistor S13, and a fourth thin film transistor S14. The pull-down control module 301 further comprises a fifth thin film transistor S31 and a first capacitor C31.

Specifically, a gate of the first thin film transistor S11 is electrically connected to a first control signal line 11. Preferably, the first control signal line 11 is an LC (Inductance-Capacitance) signal line, and the first control signal line 11 transmits a first voltage. In the present embodiment, the first voltage is a direct current high-level voltage. Preferably, when the first voltage is transmitted, a voltage value of the first voltage is same as a voltage value of the GOA circuit in the display panel at a high potential.

A gate of the second thin film transistor S12 is electrically connected to a second control signal line 12, a drain of the second thin film transistor S12 is electrically connected to a source of the first thin film transistor S11, and a source of the second thin film transistor S12 is electrically connected to a third control signal line 13. In the present embodiment, the second control signal line 12 may be a clock signal line CK(n). The third control signal line 13 is preferably a VSS (Voltage Source Source) signal line, the third control signal line 13 transmits a second voltage, and the second voltage is a DC low voltage. Preferably, a voltage value of the second voltage is same as a voltage value of the GOA circuit at a low potential.

Agate of the third thin film transistor S13 is electrically connected to the drain of the second thin film transistor S12, and a drain of the third thin film transistor S13 is electrically connected to the first control signal line 11 and a drain of the first thin film transistor S11.

A gate of the fourth thin film transistor S14 is electrically connected to the gate of the second thin film transistor S12, a drain of the fourth thin film transistor S14 is electrically connected to a source of the third thin film transistor S13, and a source of the fourth thin film transistor S14 is electrically connected to the third control signal line 13, and the third control signal line 13 may be a VSS signal line.

A gate of the fifth thin film transistor S31 is electrically connected to the drain of the fourth thin film transistor S14 and a source of the third thin film transistor S13, a drain of the fifth thin film transistor S31 is electrically connected to one end of the first capacitor C31, and a source of the fifth thin film transistor S31 is electrically connected to the third control signal line 13, the gate electrode of the fifth thin film transistor S31 is electrically connected to the drain electrode of the fourth thin film transistor S14 and the source electrode of the third thin film transistor S13, and One end of the first capacitor C31 is electrically connected to the drain of the fifth thin film transistor S31 and a gate signal line G(n) of the display panel, and the other end of the first capacitor C31 is electrically connected to a fourth control signal line 14. The fourth control signal line 14 may be a CK(n) signal line.

Further, the first thin film transistor S11, the second thin film transistor S12, the third thin film transistor S13, and the fourth thin film transistor S14 form an inverter 300. The high and low power supplies of inverter 300 are LC and VSS, respectively. An input terminal of the inverter 300 is electrically connected to the clock signal line CK(n) of the driving circuit, i.e., to the gate of the second thin film transistor S12.

An output terminal of the inverter 300 is K(n), and the output terminal K(n) is electrically connected to the gate of the fifth thin film transistor S31 and configured to perform the pull-down operation. At the same time, the source of the fifth thin film transistor S31 is electrically connected to the VSS signal line, and the drain of the fifth thin film transistor S31 is electrically connected to the other end of the vertically extending gate signal line G(n) in the display panel driving circuit, so that the circuit of the pull-down module is completed.

Figure 3:
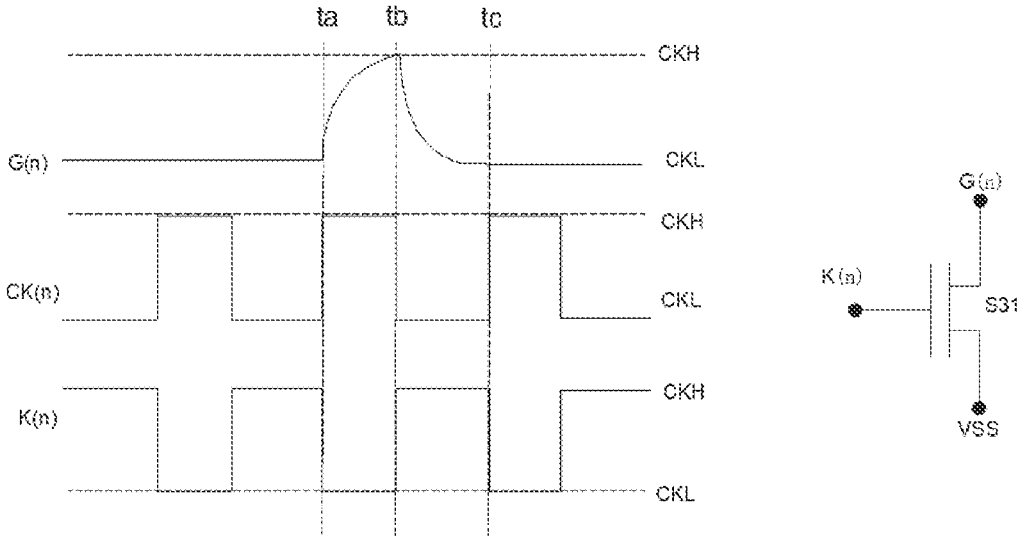
FIG. 3 is a timing signal diagram of the pull-down circuit according to the embodiment of the present disclosure.

As shown in FIG. 3, FIG. 3 is a timing signal diagram of the pull-down module according to the embodiment of the present disclosure. In the embodiment of the present disclosure, a timing diagram showing the pull-down module and the corresponding gate signal line G(n) performing a pull-down function is described as an example.

Specifically, in combination with the schematic diagram of the circuit shown in FIG. 2, the CK(n) signal is a periodic square wave signal, and when the CK(n) signal is at a high potential due to the action of the inverter 300, the K(n) is at a low potential. Therefore, the K(n) signal is also a periodic square wave signal. In the fifth thin film transistor S31, the potential signal of K(n) controls the G(n) and the VSS to turn on or off. At this time, a period from ta to tb is a high potential occupation interval of the G(n) signal, and in this interval, K(n) is at a low potential, so the G(n) and the VSS are turned off.

When the K(n) signal is switched to a high-potential signal after the time tb, the G(n) and the VSS are turned on, and a falling edge of the corresponding gate signal line G(n) is accelerated to pull down, so that the corresponding waveform can be quickly reduced to a low potential, thereby ensuring that the pixel is not charged with the data signal of a lower stage incorrectly when the gate signal is turned on, so that the charging time of the pixel is effectively improved when the falling edge of the data signal is adjusted to the time when the gate signal is lowered to a threshold voltage.

Further, in the control process, the G(n) has only one pulse in the entire frame and is at a low potential before the time ta and after the time tc. Therefore, whether the G(n) and the VSS are turned on before the time ta and after the time tc does not affect the waveform of the G(n) signal line, thereby ensuring stability in the transmission process. Further, the pull-down module provided in the embodiment of the present disclosure is activated only at a falling edge time corresponding to the gate signal.

However, for the time between tb and tc, the G(n) at a low potential is turned on to the VSS during this period of time due to signal delay, so that the G(n) is accelerated to fall. Therefore, the fall time of the G(n) can be effectively shortened.

In this embodiment of the present disclosure, a signal connected to the gate of the fifth thin film transistor S31 is the signal K(n) outputted by the inverter 300, so that the requirement that the pull-down circuit unit adapts to the duty ratio of the various clock signals CK(n) can be ensured. When the inverter 300 is used, a rising edge of the K(n) always corresponds to a falling edge of the CK(n), and therefore also corresponds to the falling edge of the G(n), regardless of how much the duty ratio of the clock signal is adjusted. Further, the first capacitance C31 is a compensation capacitance provided to cancel interference to the G(n) caused by capacitive coupling of the K(n) to the G(n). Preferably, a capacitance value of the first capacitance C31 is same with a drain-gate parasitic capacitance value of the fifth thin film transistor S31. Preferably, the devices in the inverter and the pull-down control module in the embodiment of the present disclosure are merely examples, and may be constituted by other devices. Details are not described herein.

Further, engineering indexes such as a descending time of a falling edge of a scanning signal of the four thin film transistors corresponding to the internal inverter 300 of the pull-down module may be determined according to an actual product. In the embodiment of the present disclosure, whether the pull-down of the pull-down module is effective in time depends on the potential response of the K(n) point. If waveform of the K(n) has a serious delay rather than a normal square wave waveform, the drain and source of the fifth thin film transistor S31 is turned on, so that there is a delay problem and a pull-down of the G(n) is delayed. Meanwhile, when the potential of the K(n) rises, the parasitic capacitance is charged, and the charging process increases the rise time of the potential of the K(n). Therefore, the pull-down module provided in the embodiment of the present disclosure can be well matched with the display panel, and the display panel can be optimally performed when each control signal is transmitted to the display panel.

Figure 4:
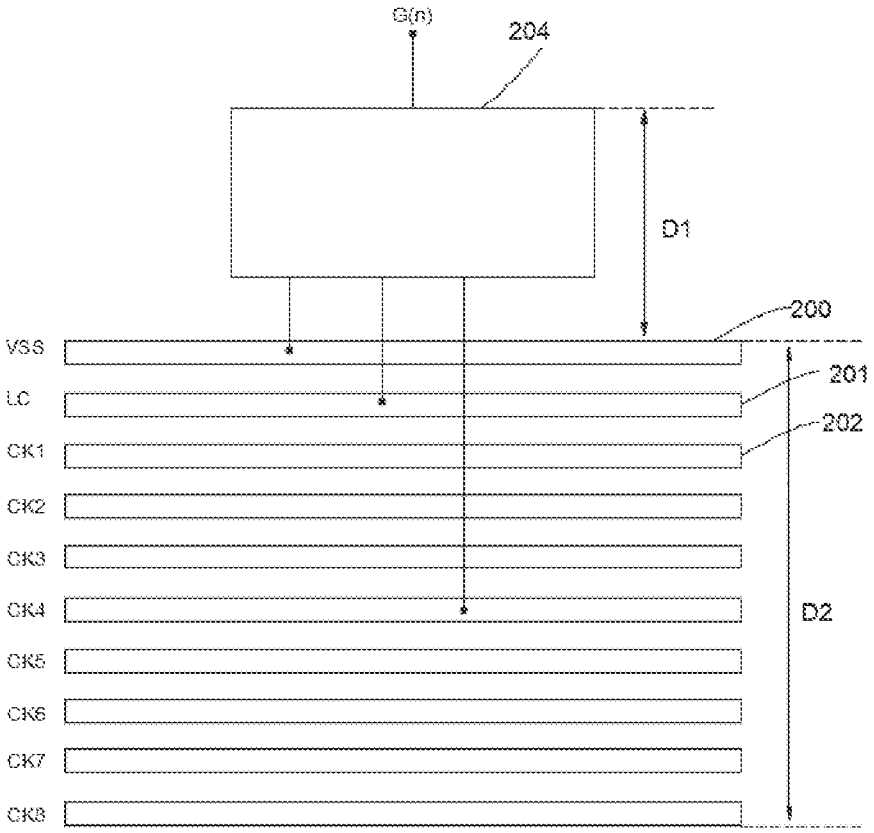
FIG. 4 is a structural schematic diagram of a connection between the pull-down module and a control bus in an embodiment of the present disclosure.

Further, as shown in FIG. 4, FIG. 4 is a schematic diagram of a connection structure between the pull-down module and the control bus in the embodiment of the present disclosure. In the embodiment of the present disclosure, the control bus provides a control signal for the pull-down module, and the control bus can extend directly from the driving chip of the display panel and is connected to the pull-down module at the end of the pull-down module.

Specifically, the control bus may comprise a plurality of driving signal lines, and adjacent signal lines may be disposed at equal intervals. Specifically, the driving signal line may comprise a power supply voltage signal line VSS, a clock signal line CK, a signal line LC, etc., and different driving signals are supplied to the pull-down module through the control bus.

In order to realize the narrow-frame display panel, when each driving signal line is provided, it is ensured that a width of the control bus is as narrow as possible. In the present embodiment, each of the control signal lines may be arranged at equal intervals; that is, a width of each of the control signal lines such as the power supply signal line 200 and the low frequency signal line 201 is not more than 65 um, preferably 65 um, and an interval between two adjacent signal lines is not more than 15 um, preferably 15 um.

Further, in this embodiment of the present disclosure, a pull-down module 204 is disposed on the control bus, and the pull-down module 204 is electrically connected to the corresponding driving signal lines through corresponding wires. In this embodiment of the present disclosure, only the control bus is disposed on the left and right sides of the display panel. Specifically, in order to realize narrow frame, when the pull-down module 204 and the control bus are provided, a distance between a side of the pull-down module 204 away from the control bus and an upper side of the control bus is D1=650 um, and a total width of the control bus is D2=785 um. Thus, a wiring width at the bottom of the display panel is 1435 um, and a width of the display panel is increased by only D2. Therefore, the stability of the transmission signal of the display panel is ensured, and the purpose of narrow frame is achieved. The distance can also be set according to the needs of the actual product.

In some embodiments, in order to ensure the pull-down function of the pull-down module of the display panel while realizing a narrow-frame panel, when the fifth thin film transistor S31 in the pull-down control module configured to perform the pull-down operation is provided, a size of the fifth thin film transistor S31 should not be too large or too small. If the fifth thin film transistor S31 is too small, the pull-down channel resistance is too large and the pull-down effect is weak. Therefore, in order to improve the waveform of the K(n), the size of the four thin film transistors of the inverter 300 can be appropriately increased, thereby reducing the resistance and ensuring the normal waveform of the K(n). In this embodiment of the present disclosure, a size of each thin film transistor may be set according to a specific product.

Figure 5:
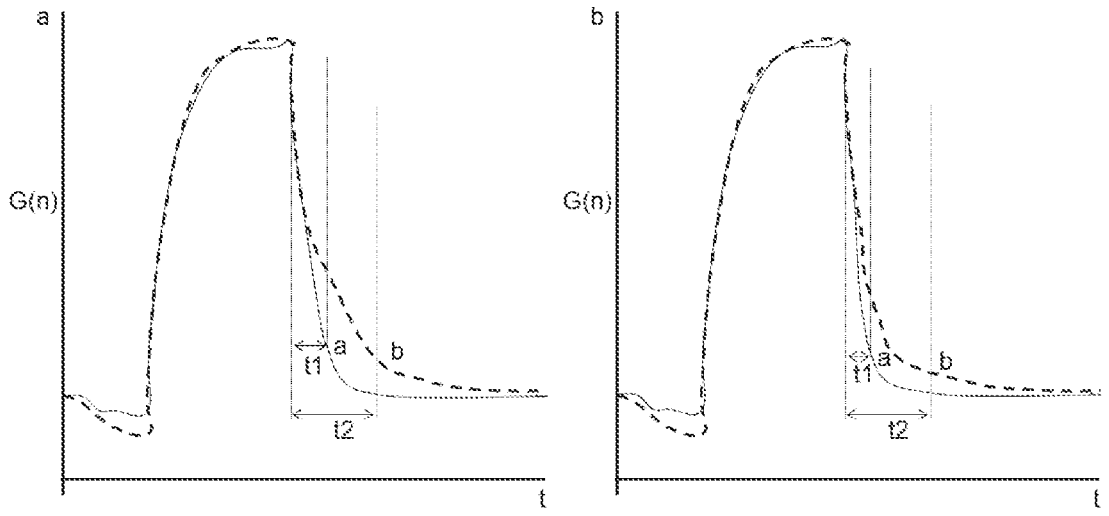
FIG. 5 is a schematic diagram of a variation waveform of a falling edge of the pull-down module according to an embodiment of the present disclosure.

Further, as shown in FIG. 5, FIG. 5 is a schematic diagram of a variation waveform of a falling edge of the pull-down module according to an embodiment of the present disclosure. The pull-down module provided by this embodiment of the present disclosure is compared with the control bus and no pull-down module is added to the circuit of the display panel. Wherein, FIG. a in FIG. 5 is a drawing-down variation when the duty ratio of the CK signal is 50%, and FIG. b in FIG. 5 is a pull-down waveform variation when the duty ratio of the CK signal is 40%. The solid line represents a pull-down circuit unit in the circuit, and the dashed line represents no pull-down circuit unit in the circuit. Meanwhile, t1 and t2 are the falling edge times in both cases.

Meanwhile, with reference to the timing diagram in FIG. 3, when the measurement is performed, the high potential of the scanning signal line in the present embodiment is set to 32V, the low potential is set to −5V, and the potential change ΔV is set to 37V. T1 and t2 shown in the figure represent the time taken for G(n) to decrease from 0.1ΔV to 0.9ΔV. It can be seen that only the falling edge of the gate signal line is changed, and the pull-down unit does not cause waveform abnormality in the rising edge and the blank signal region. When the duty ratio is 50%, the descent time of the falling edge is reduced from t2=16.969 us to t1=8.0293 us, and 52.68% is reduced. When the duty ratio of the CK is 40%, the descent time of the falling edge is reduced by 29.13% from t2=7.8671 us before improvement to t1=5.5757 us after improvement. It can be seen that the pull-down circuit unit provided in the embodiment of the present disclosure has a significant improvement in the falling edge of the gate signal.

Figure 6:
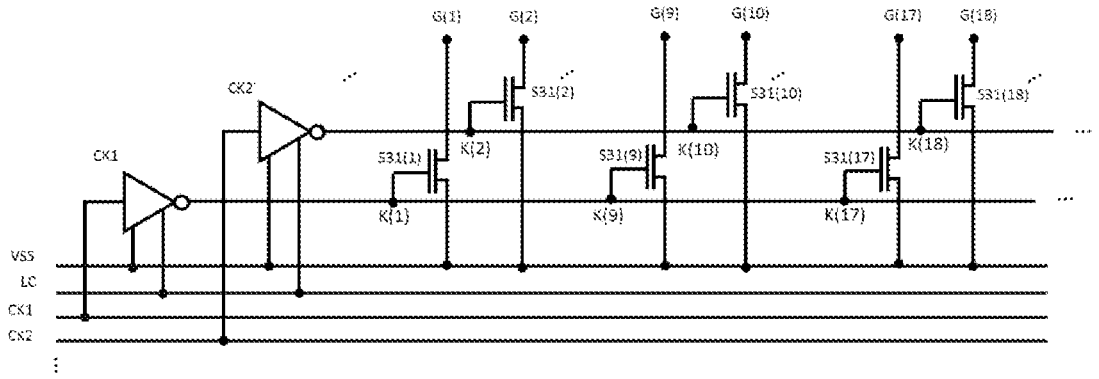
FIG. 6 is a structural schematic diagram of a circuit of another pull-down module according to an embodiment of the present disclosure.

Further, as shown in FIG. 6, FIG. 6 is a schematic diagram of a circuit structure of another pull-down module according to an embodiment of the present disclosure. Referring to FIGS. 1 to 5, in the present embodiment, the K(n) signal may be connected not only to the gate of the fifth thin film transistor S31, but also to the gates of a series of thin film transistors such as S31(n+8), S31(n+16), and S31(n+8i). Thus, a series of S31(n+8), S31(n+16), S31(n+8i), etc., where i=0, 1, 2, . . . , can share the inverter. Specifically, the fifth thin film transistor S31 performing pull-down may be separately configured, as shown in the connection structure in FIG. 6. FIG. 6 only shows the circuit configuration of the S31 (1+8i) series and the S31(2+8i) series (i=0, 1, 2, . . . ) For other gate signal lines, for example, S31(3+8i), are omitted from the drawing.

Further, for a rectangular narrow-frame panel, since a number of vertically distributed gate signal lines is far less than a number of data lines, more space can be reserved in an opposite side frame region of the GOA circuit to place the shared inverter, and the fifth thin film transistor S31 performing pull-down can be disposed in a region corresponding to the pixel cells connected by the vertically distributed gate signal lines. Thus, a width of the pull-down circuit is further reduced. The design of the narrow-frame panel is achieved.

An embodiment of the present disclosure further provides a display device comprising a display panel and a driving circuit provided in this embodiment of the present disclosure, the display device having a high transmission quality when transmitting a driving signal and a good display effect.

The driving circuit and the display device of a display panel according to an embodiment of the present disclosure are described in detail. A specific example is used to explain the principles and embodiments of the present disclosure. The description of the above embodiment is only used to help understand the technical solution and the core idea of the present disclosure. It will be appreciated by those of ordinary skill in the art that modifications may still be made to the technical solutions described in the foregoing embodiments, or equivalents may be made to some of the technical features therein. These modifications or substitutions do not depart the essence of the corresponding technical solutions from the scope of the technical solutions of the embodiments of the present disclosure.

What is claimed is:

1. A driving circuit of a display panel, comprising:

a gate-on-array (GOA) circuit comprising a GOA unit connected to one end of a gate signal line to transmit a scan driving signal to the display panel; and a pull-down module, wherein one end of the pull-down module is connected to a control bus, the other end of the pull-down module is connected to the other end of the gate signal line, and the pull-down module is activated at a falling edge time of the scan driving signal to accelerate a potential descending speed of the scan driving signal;

wherein the driving circuit of the display panel further comprises a timing controller, the control bus is connected to the timing controller and the pull-down module, and the control bus comprises a plurality of clock signal lines and power supply voltage signal lines, and two adjacent signal lines are arranged at equal intervals.

2. The driving circuit of the display panel according to claim 1, wherein the control bus is disposed around a non-display area of the display panel, the timing controller and the GOA circuit are disposed on one side of the display panel, and the pull-down module is disposed on the other side of the display panel.

3. The driving circuit of the display panel according to claim 1, wherein the pull-down module comprises an inverter and a pull-down control module, an input terminal of the inverter is connected to the control bus, an output terminal of the inverter is connected to one end of the pull-down control module, and the other end of the pull-down control module is correspondingly connected to the other end of the gate signal line.

4. The driving circuit of the display panel according to claim 3, wherein the inverter comprises:

a first thin film transistor, wherein a gate of the first thin film transistor is electrically connected to a first control signal line;

a second thin film transistor, wherein a gate of the second thin film transistor is electrically connected to a second control signal line, a drain of the second thin film transistor is electrically connected to a source of the first thin film transistor, and a source of the second thin film transistor is electrically connected to a third control signal line;

a third thin film transistor, wherein a gate of the third thin film transistor is electrically connected to the drain of the second thin film transistor, and a drain of the third thin film transistor is electrically connected to the first control signal line and a drain of the first thin film transistor;

a fourth thin film transistor, wherein a gate of the fourth thin film transistor is electrically connected to the gate of the second thin film transistor, a drain of the fourth thin film transistor is electrically connected to a source of the third thin film transistor, and a source of the fourth thin film transistor is electrically connected to the third control signal line.

5. The driving circuit of the display panel according to claim 4, wherein the pull-down control module comprises a fifth thin film transistor and a first capacitor, wherein a gate of the fifth thin film transistor is electrically connected to the drain of the fourth thin film transistor and the source of the third thin film transistor, a source of the fifth thin film transistor is electrically connected to the third control signal line, and a drain of the fifth thin film transistor is connected to the other end of the gate signal line, wherein one end of the first capacitor is electrically connected to the drain of the fifth thin film transistor and the other end of the gate signal line, and the other end of the first capacitor is electrically connected to a fourth control signal line.

6. The driving circuit of the display panel according to claim 4, wherein the first control signal line transmits a first voltage, the first voltage is a direct current high-level voltage, and a voltage value of the first voltage is same as a voltage value of the GOA circuit at a high potential.

7. The driving circuit of the display panel according to claim 6, wherein the third control signal line transmits a second voltage, the second voltage is a direct current low-level voltage, and a voltage value of the second voltage is same as a voltage value of the GOA circuit at a low potential.

8. A driving circuit of a display panel, comprising:

a gate-on-array (GOA) circuit comprising a GOA unit connected to one end of a gate signal line to transmit a scan driving signal to the display panel; and a pull-down module, wherein one end of the pull-down module is connected to a control bus, the other end of the pull-down module is connected to the other end of the gate signal line, and the pull-down module is activated at a falling edge time of the scan driving signal to accelerate a potential descending speed of the scan driving signal, wherein the driving circuit of the display panel further comprises a timing controller, and the control bus is connected to the timing controller and the pull-down module.

9. The driving circuit of the display panel according to claim 8, wherein the control bus is disposed around a non-display area of the display panel, the timing controller and the GOA circuit are disposed on one side of the display panel, and the pull-down module is disposed on the other side of the display panel.

10. The driving circuit of the display panel according to claim 8, wherein the pull-down module comprises an inverter and a pull-down control module, an input terminal of the inverter is connected to the control bus, an output terminal of the inverter is connected to one end of the pull-down control module, and the other end of the pull-down control module is correspondingly connected to the other end of the gate signal line.

11. The driving circuit of the display panel according to claim 10, wherein the inverter comprises:

a first thin film transistor, wherein a gate of the first thin film transistor is electrically connected to a first control signal line;

a second thin film transistor, wherein a gate of the second thin film transistor is electrically connected to a second control signal line, a drain of the second thin film transistor is electrically connected to a source of the first thin film transistor, and a source of the second thin film transistor is electrically connected to a third control signal line;

a third thin film transistor, wherein a gate of the third thin film transistor is electrically connected to the drain of the second thin film transistor, and a drain of the third thin film transistor is electrically connected to the first control signal line and a drain of the first thin film transistor;

a fourth thin film transistor, wherein a gate of the fourth thin film transistor is electrically connected to the gate of the second thin film transistor, a drain of the fourth thin film transistor is electrically connected to a source of the third thin film transistor, and a source of the fourth thin film transistor is electrically connected to the third control signal line.

12. The driving circuit of the display panel according to claim 11, wherein the pull-down control module comprises a fifth thin film transistor and a first capacitor, wherein a gate of the fifth thin film transistor is electrically connected to the drain of the fourth thin film transistor and the source of the third thin film transistor, a source of the fifth thin film transistor is electrically connected to the third control signal line, and a drain of the fifth thin film transistor is connected to the other end of the gate signal line, wherein one end of the first capacitor is electrically connected to the drain of the fifth thin film transistor and the other end of the gate signal line, and the other end of the first capacitor is electrically connected to a fourth control signal line.

13. The driving circuit of the display panel according to claim 11, wherein the first control signal line transmits a first voltage, the first voltage is a direct current high-level voltage, and a voltage value of the first voltage is same as a voltage value of the GOA circuit at a high potential.

14. The driving circuit of the display panel according to claim 13, wherein the third control signal line transmits a second voltage, the second voltage is a direct current low-level voltage, and a voltage value of the second voltage is same as a voltage value of the GOA circuit at a low potential.

15. The driving circuit of the display panel according to claim 8, wherein the control bus comprises a plurality of clock signal lines and power supply voltage signal lines, and two adjacent signal lines are arranged at equal intervals.

16. A display device comprising a driving circuit of a display panel, wherein the driving circuit comprises:

a gate-on-array (GOA) circuit comprising a GOA unit connected to one end of a gate signal line to transmit a scan driving signal to the display panel; and a pull-down module, wherein one end of the pull-down module is connected to a control bus, the other end of the pull-down module is connected to the other end of the gate signal line, and the pull-down module is activated at a falling edge time of the scan driving signal to accelerate a potential descending speed of the scan driving signal, wherein the driving circuit of the display panel further comprises a timing controller, and the control bus is connected to the timing controller and the pull-down module.

17. The driving circuit of the display panel according to claim 16, wherein the control bus is disposed around a non-display area of the display panel, the timing controller and the GOA circuit are disposed on one side of the display panel, and the pull-down module is disposed on the other side of the display panel.

18. The driving circuit of the display panel according to claim 16, wherein the pull-down module comprises an inverter and a pull-down control module, an input terminal of the inverter is connected to the control bus, an output terminal of the inverter is connected to one end of the pull-down control module, and the other end of the pull-down control module is correspondingly connected to the other end of the gate signal line.

* * * * *